US005711757A

United States Patent [19]

Bryant

[11] Patent Number: 5,711,757

[45] Date of Patent: Jan. 27, 1998

[54] CONTROLLER ESPECIALLY FOR PNEUMATIC CONTINUOUS PASSIVE MOTION DEVICES

[75] Inventor: Julian D. Bryant, Huntington, Great Britain

[73] Assignee: Neoligaments Limited, Leeds, England

[21] Appl. No.: 633,748

[22] PCT Filed: Oct. 19, 1994

[86] PCT No.: PCT/GB94/02293

§ 371 Date: Apr. 19, 1996

§ 102(e) Date: Apr. 19, 1996

[87] PCT Pub. No.: WO95/10998

PCT Pub. Date: Apr. 27, 1995

[30] Foreign Application Priority Data

Oct. 20, 1993 [GB] United Kingdom ..... 9321602

[51] Int. Cl.[6] ..... A61H 1/00

[52] U.S. Cl. ..... 601/23; 601/33; 601/150; 137/115.13; 251/75; 251/294

[58] Field of Search ..... 601/5, 24, 26, 601/29, 31, 40, 33, 34, 35, 88, 96, 105, 148, 150; 602/13; 128/DIG. 20; 5/615, 655.3; 137/115.13, 115.24; 251/75, 294

[56] References Cited

U.S. PATENT DOCUMENTS

| | | | |
|---|---|---|---|
| 2,745,425 | 5/1956 | Jensen | 137/115.15 |
| 2,856,147 | 10/1958 | Knapp | 601/150 |
| 2,945,506 | 7/1960 | Svensson | 251/294 |
| 3,101,187 | 8/1963 | Campbell | 137/115.13 |
| 4,068,334 | 1/1978 | Randall | 601/148 |
| 4,099,276 | 7/1978 | Hunt et al. | 5/615 |
| 4,796,656 | 1/1989 | Phillips et al. | 251/75 |
| 4,923,168 | 5/1990 | Murata et al. | 251/75 |
| 5,033,457 | 7/1991 | Bonutti . | |

FOREIGN PATENT DOCUMENTS

| | | | |
|---|---|---|---|
| 1007595 | 5/1952 | France . | |
| 1597802 | 10/1970 | France . | |
| 4011203 | 4/1991 | Germany | 601/33 |
| 9217225 | 12/1992 | Germany . | |
| 842890 | 7/1960 | United Kingdom . | |
| 2 244 923 | 12/1991 | United Kingdom . | |

*Primary Examiner*—Jeanne M. Clark
*Attorney, Agent, or Firm*—Madson & Metcalf

[57] ABSTRACT

A controller (10) having a housing (11) within which is positioned a moveable portion (13). The housing comprises an outer housing portion (12*a*) and an inner housing portion (12*b*) and having a vent (14) and a limit peg (22). Detent means (15) defines the lower position limit of the movement of the inner housing portion (12*b*) and second detent means (16) defines the upper limit of the movement of the inner housing portion (12*b*) with the outer housing portion (12*a*). Biasing means (17) biases the moveable portion 13 to a first position. The device further comprises an inlet (19) attachable to a pump and an outlet (20) connectable to an inflatable body to form part of a continuous passive motion device.

17 Claims, 7 Drawing Sheets

CONTROLLER ESPECIALLY FOR PNEUMATIC CONTINUOUS PASSIVE MOTION DEVICES

This invention relates to a controller, and particularly but not exclusively to a controller for controlling inflation and deflation of an inflatable device, particularly to a controller for controlling inflation and deflation of an inflatable device for use in continuous passive motion devices, and to a device incorporating such a controller.

It is known that after surgery or injury, the joints or other parts of the bodies of human or other animals may become stiff whilst the joint is healing. In order to reduce stiffness and increase the speed of recovery, it is known that movement in the joint is beneficial.

Natural or active motion, for example walking, is known to be very beneficial. Unfortunately, under certain circumstances, for example, after surgery, a person may not be able to engage in active motion as activities such as walking are too painful. Under such circumstances, exercise by continuous passive motion may be more suitable.

A known continuous passive motion (CPM) device comprises one or more inflatable bodies, for example bladders or bags adapted to be repeatedly inflated and deflated over a period of time. A part of the body of a patient to be exercised, for example a knee joint, is supported by the inflatable body. Repeated inflation and deflation of the inflatable body results in movement of the joint without any effort required on the part of the patient. Such movement is know as passive movement.

Another known CPM device comprises support means for supporting a joint to be exercised, which support means is moveable in a controllable manner to passively exercise the joint.

A problem with known CPM devices is that it is necessary to use sophisticated control means, for example electronic devices to control the movement of the CPM device. This is because if a CPM device is used for example to exercise a knee joint, as the inflatable body inflates, the pressure exerted on the inflatable body by the thigh of the patient whose knee is being exercised decreases as the angle of flexion increases. This means that it is not possible to control the inflation and deflation of the CPM device by for example monitoring pressure.

According to a first aspect of the present invention there is provided a device having an open position and a closed position, the device comprising:

housing;

a moveable portion moveable within the housing between a first position and a second position; and positioning means for causing the moving portion to return to the first position after movement to or towards the second position.

The device according to the first aspect of the present invention is mechanically simple and therefore relatively cheap.

When the moveable portion is in the first position, the switch is in the closed position, and when the moveable portion is in the second position, the switch is in the open position.

According to a second aspect of the present invention there is provided a continuous passive motion device comprising:

a controller according to the first aspect of the present invention, an inflatable body attachable to the controller, and pump means attachable to the controller, wherein in use when the controller is in the closed position, the inflatable body may be inflated by the pump means, and when the controller is in the open position, the inflatable body may be allowed to deflate.

Preferably the positioning means comprises first biasing means for biasing the moving portion in the first position.

Conveniently the device further comprises at least one aperture which aperture is closed when the moveable portion is in its first position, and open when the moveable portion is in its second position.

Advantageously the inflatable body is attachable to the controller by elongate member having a first end and a second end, the first end of the elongate member being attachable to the inflatable body, and the second end of the elongate member being attachable to the moveable portion of the controller.

Preferably the elongate means comprises a length of elastic.

When the controller is in the closed position, i.e. when the aperture or vent is closed, the pump means causes air or other fluid to be pumped into the inflatable body. As the inflatable body inflates, the elongate member which is attached to the inflatable body and to the moveable portion of the controller causes the moveable portion to move within the housing as the inflatable body inflates. As the inflatable body inflates, the moveable portion moves within the housing away from the first position towards the second position in which the controller is in an open position and the aperture or vent is open. At this point, the inflatable body begins to deflate and the moveable portion is at its second position.

Preferably, the controller further comprises second biasing means responsive to the relative position of the moveable portion within the housing, to cause the moveable portion to move from a predetermined position to either the first position or the second position.

The second biasing means causes the moveable portion to flip back from the second position to the first position after the inflatable body has deflated and from the first position to the second position when the inflatable body has inflated. The controller is adjustable, and the bag may be allowed to inflate and deflate for any desired range of movement according to the use to which the CPM device is put.

Once the moveable portion has returned to the first position, the controller will again be in the closed position, and inflation of the inflatable body may resume, and the cycle repeats itself for as long as it is desired.

Advantageously, the controller comprises an elongate body having an elongate housing within which is positioned the moveable portion.

Preferably the first biasing means comprises a retractor spring attachable to a first end of the moveable portion and to a first end of the housing.

Alternatively, the first biasing means comprises a compression spring attachable to a second end of the moveable portion and to the housing.

Conveniently the second biasing means comprises a disc spring attachable to a second end of the moveable portion and engageable with the housing.

The second biasing means may thus introduce mechanical hysteresis into the controller. This ensures that the moveable portion flips from a position close to its first position (vent closed), to its second position (vent open) before deflation of the inflatable body has begun. Similarly, the moveable body flips from a position close to its second position, back to its first position before inflation of the inflatable body has begun.

Conveniently, the housing comprises an outer housing portion and an inner housing portion and at least one vent is formed in the inner housing portion.

The device further comprises a sleeve moveable to close at least one vent when the moveable portion is in the first position. The sleeve may be caused to move over the/or each vent or away from the/or each vent depending on the position of the moveable portion within the housing.

Mechanical hysteresis is not a necessary feature of the present invention. However, it can be very useful, in that in some designs of controller, if mechanical hysteresis were not present, the controller may reach an equilibrium position in which the vent is partially open, and the amount of air entering the inflatable portion is essentially equal to the amount of air exiting from the inflatable portion. This is not a desirable effect in that the inflatable body would cease to deflate and inflate as desired.

Advantageously the moveable portion is positioned within the sleeve which in turn is positioned within the inner housing portion.

Advantageously the housing is shaped to have first detent means defining a lower displacement limit of the moveable portion within the housing, and second detent means defining an upper displacement limit of the moveable portion within the housing.

Preferably, the positions of the first and second detent means are adjustable.

Alternatively, the moveable portion is substantially disc shaped and is positionable within a housing having a curved portion to accommodate the disc. The controller further comprises a paddle pivotally moveable between a first position and a second position.

Preferably the first biasing means comprises a coil or retractor spring and the second biasing means comprises a flat spring attachable to the paddle.

The invention will now be further described by way of example only with reference to the accompanying drawings in which.

Figure 4A:
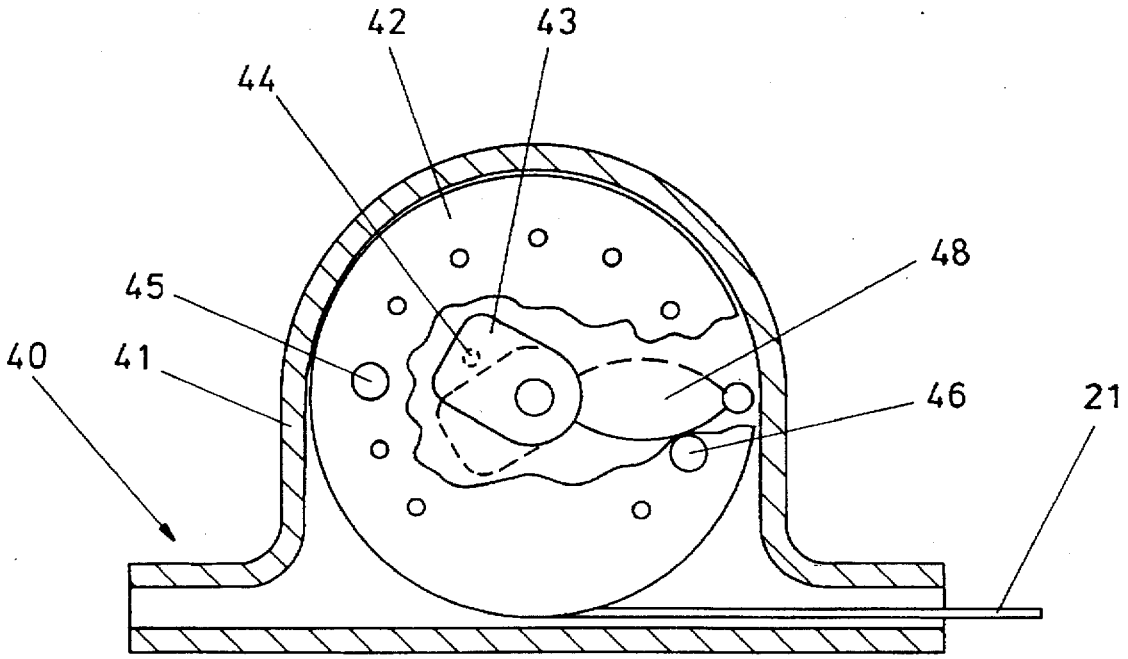
Figure 5:
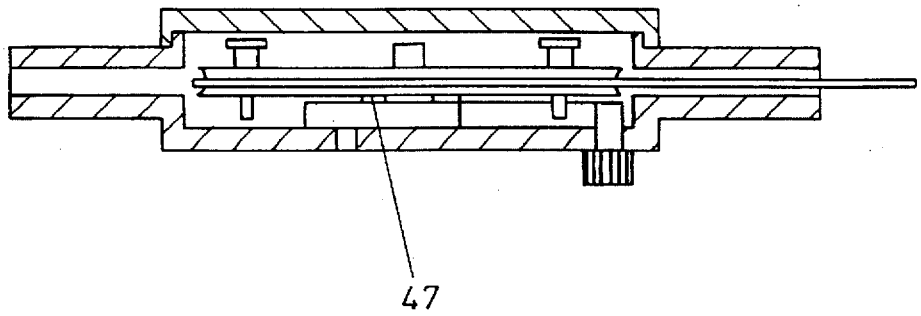
Figure 4B:
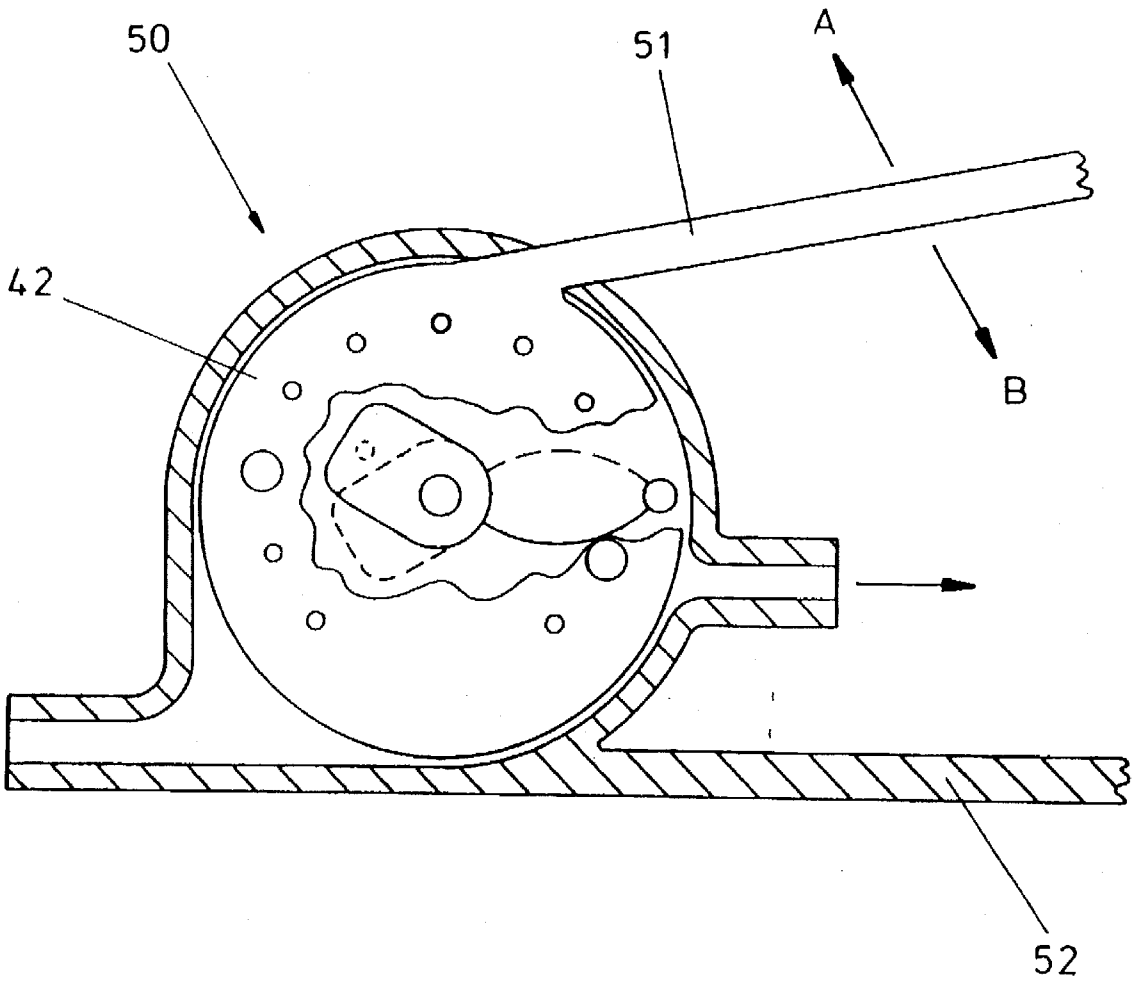
Figure 6:
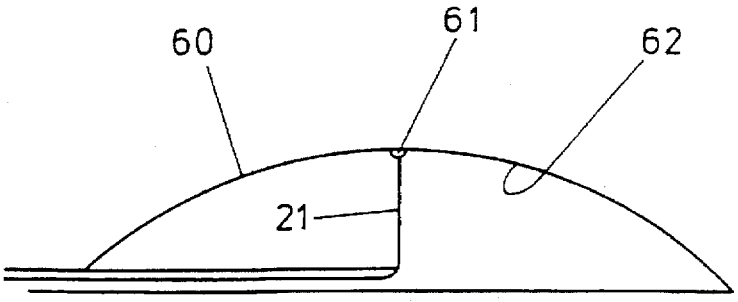
Figure 7:
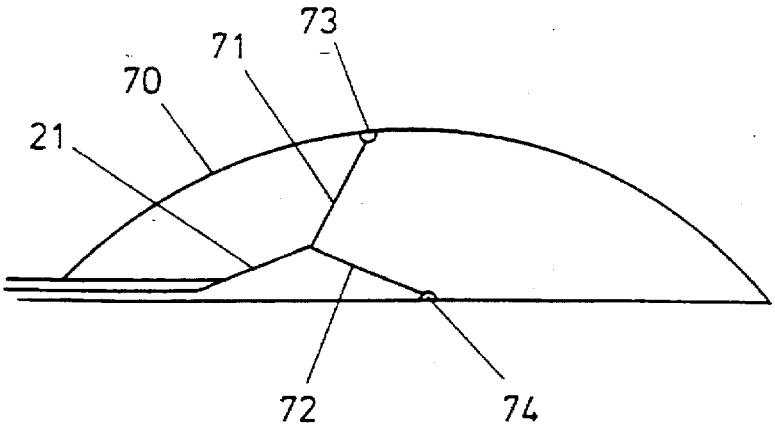
Figure 8:
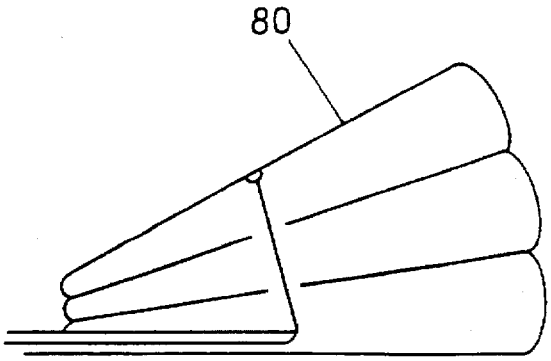
Figure 9:
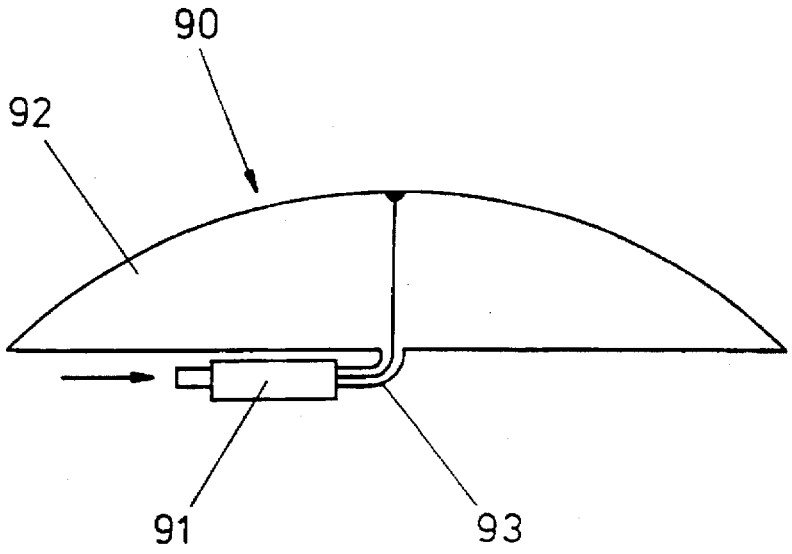
Figure 10:
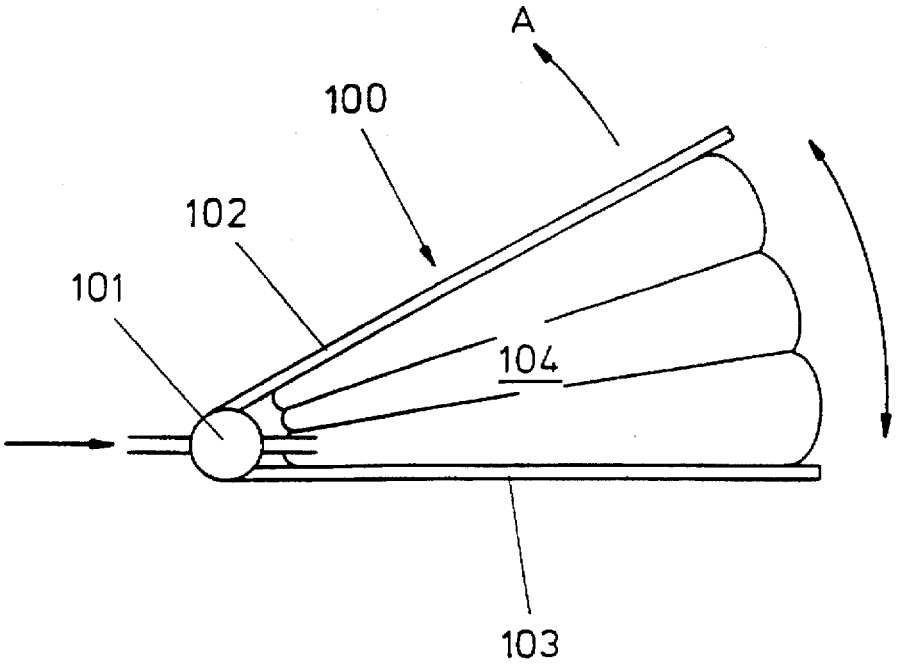

FIG. 4*a* is a schematic representation second embodiment of a controller according to the present invention in which the moveable portion is in the shape of a disc and the elongate member is a thread;

FIG. 4*b* is a schematic representation of a further embodiment of a controller according to the present invention in which the moveable portion is in the shape of a disc and the elongate member is a rod extending from the disc;

FIG. 5 is a schematic representation of the controller of FIG. 4 when viewed from the side; and FIGS. 6 to 8 are schematic representations of possible configurations of an inflatable body forming part of the continuous passive motion device according to the second aspect of the present invention;

FIG. 9 is a schematic representation of a CPM device according to the second aspect of the invention in which the controller is connected to the inflatable body by means of a connecting tube; and FIG. 10 is a schematic representation of a CPM device according to the second aspect of the invention comprising the controller of FIG. 4*b*.

Figure 1:
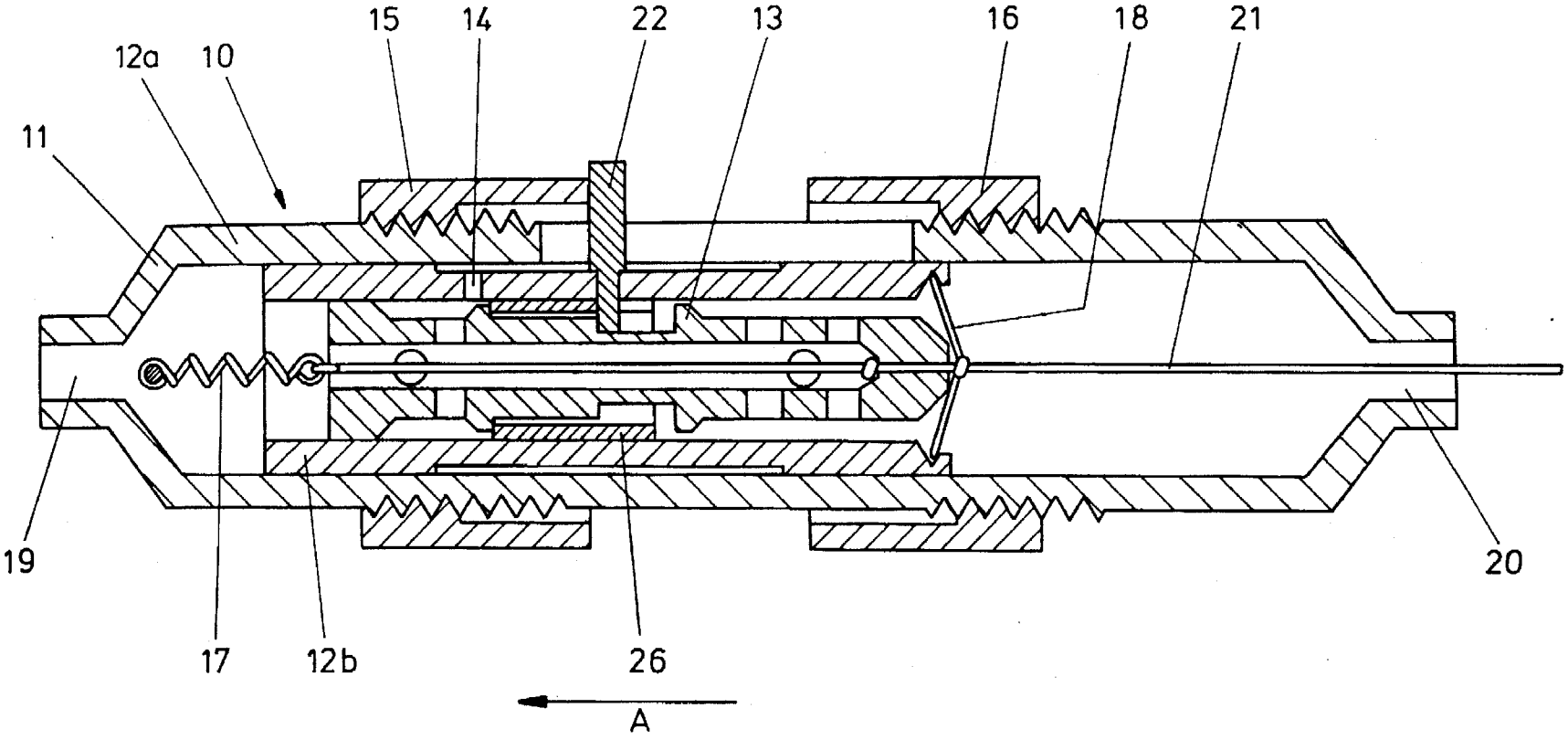
FIG. 1 is a schematic representation of a controller according to a first aspect of the present invention in which the moveable portion is positioned at the open position.

Referring to FIG. 1 a controller according to the first aspect of the present invention is designated generally by the reference numeral 10. The controller 10 comprises housing 11 within which is positioned a moveable portion 13. The housing comprises an outer housing portion 12*a* and an inner housing portion 12*b* and having a vent 14 and a limit peg 22. The device further comprises a first detent means 15 which defines the lower positional limit of the movement of the inner housing portion 12*b* and a second detent means 16 which defines the upper limit of the movement of the inner housing portion within the outer housing portion 12*a*. A sleeve 26 is positioned within inner housing portion 12*b*. First biasing means in the form of a retractor spring 17 biases the moveable portion 13 to a first position defined by the position of the limit peg 22 in conjunction with the first detent means 15 in which the controller is in a closed position. The controller 10 further comprises second biasing means in the form of a diaphragm spring 18. The moveable portion 13 is in the form of a spool. The device 10 further comprises an inlet 19 attachable to a pump and an outlet 20 connectable to an inflatable body to form part of a CPM device according to the second aspect of the present invention. The moveable portion 13 is connectable to a surface of the inflatable body by means of an elongate member 21 which may be in the form of an elastic thread.

In FIG. 1, the position of the moveable portion 13 within the inner housing portion 12*b* is nearing its first position defined by the position of first detent means 15. In this position the vent 14 is open, which means that air entering the controller from the pump (not shown) via inlet 19 exits the device via the vent 14 and will not therefore reach the inflatable body (not shown) which also deflates through this vent. This means that the inflatable body will deflate, causing an end of the elongate member attached to the inflatable body to move generally in the direction of arrow A resulting in the moveable portion also moving in the direction of arrow A.

Figure 2:
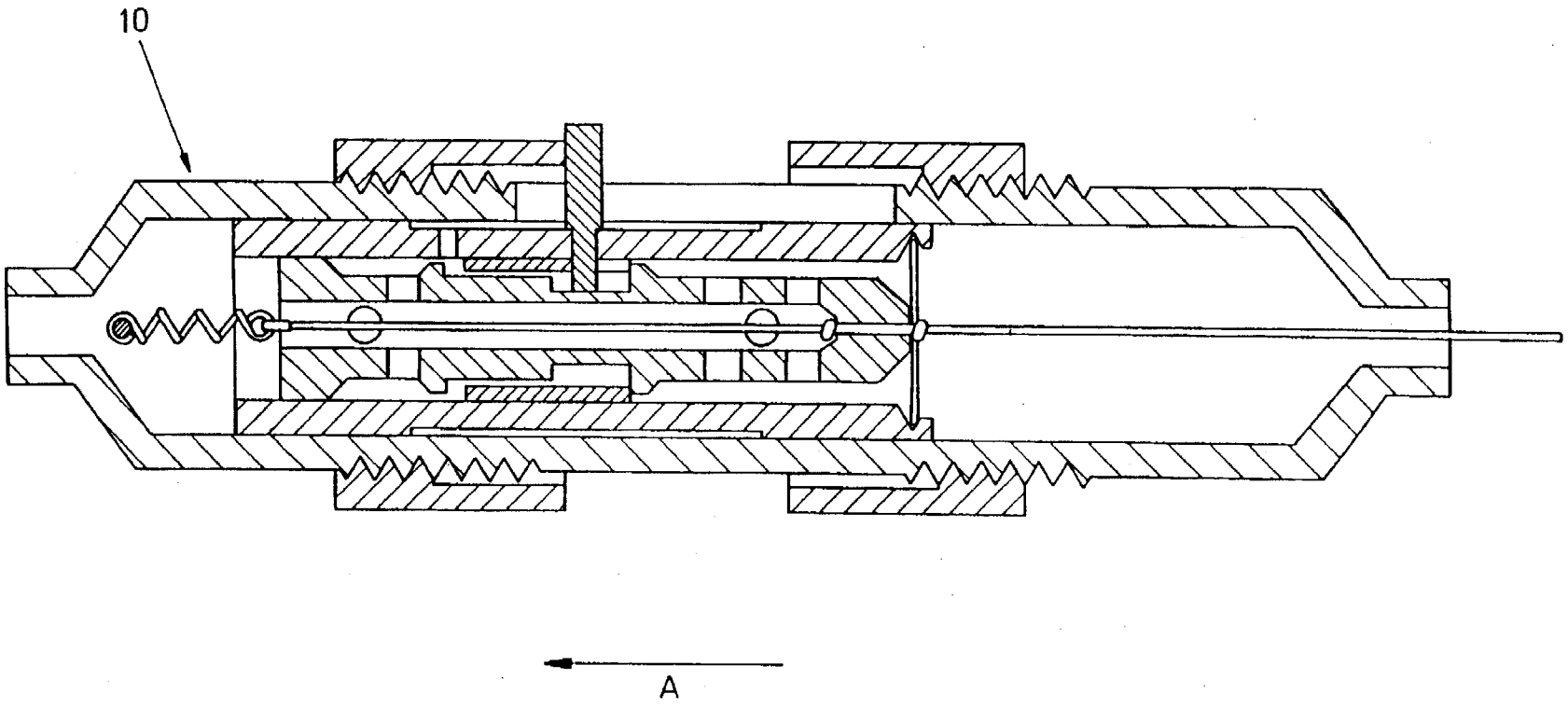
FIG. 2 is a schematic representation of the controller of FIG. 1 in which the moveable portion is approximately half way through its movement between the open position and the closed position.
Figure 3:
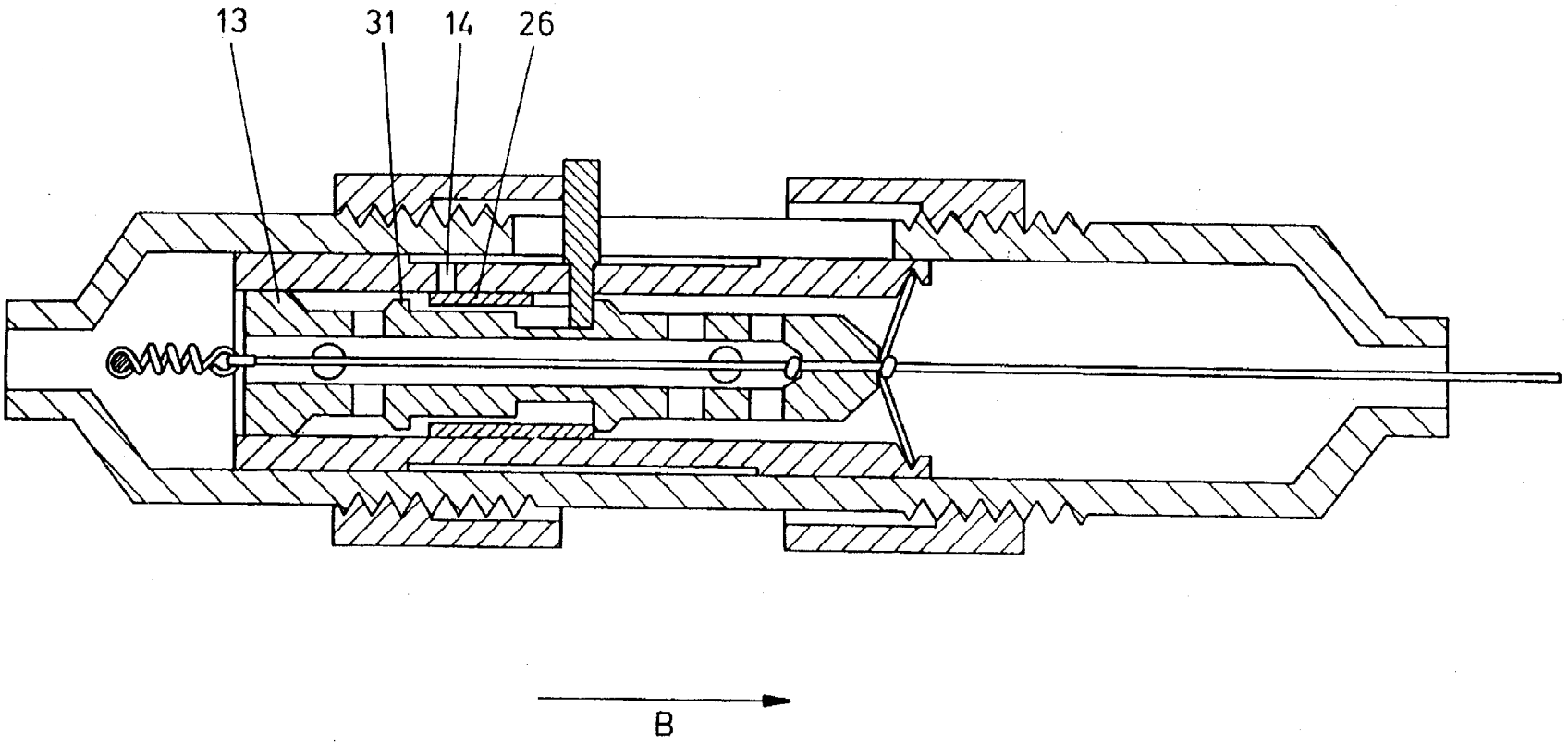
FIG. 3 is a schematic representation of the controller of FIG. 1 in which the moveable portion is at the closed position.

Referring to FIG. 2 the device 10 is shown after the moveable portion 13 has moved some distance in the direction of arrow A. In this position, the vent still remains open, and the inflatable body continues to deflate. A part 25 of moveable portion 13 has moved into engagement with sleeve 26. This provides temporary resistance to further movement of the moveable portion 13 in the direction of arrow A. Further deflation will cause the diaphragm spring to "flip" pushing the moveable portion 13 in the direction of arrow A. The further movement of the moveable portion 13 results in part 25 pushing sleeve 26 also in the direction of arrow A, which in turn causes inner sleeve 26 to move into a position where vent 14 is closed, as shown in FIG. 3.

Air entering inlet 19 is directed through device 10 and exits via outlet 20 and enters the inflatable body (not shown). As inflation progresses, the moveable portion 13 moves in the direction of arrow B as shown in FIG. 3. The device remains in its inflation mode until portion 31 of the moveable portion 13 engages with sleeve 26. At this point, further movement of the moveable portion in the direction of arrow B will result in the sleeve 26 moving away from vent 14 thus putting the device 10 in an open state once more. The cycle will thus repeat.

Referring to FIGS. 4*a* and 5 a second embodiment of the controller according to the first aspect of the invention is shown. The controller 40 comprises a housing 41 within which is positioned a moveable portion 42 in the form of a disc. An elongate member 21 is attachable to the moveable portion 42 and to a surface of the inflatable body (not shown). The controller further comprises a paddle 43 and a vent 44, a lower limit peg 45 and an upper limit peg 46 which are attached to the moveable portion 42 and which interact with the flat spring 48 of the paddle 43 and vent 44. The dotted outline of the paddle indicates the position of the paddle during deflation, whereas the solid outline of the paddle indicates the position of the paddle during inflation. First biasing means comprises a coiled retractor spring 47 joined at one end of the housing 41 and at the other end to moveable portion 42, and second biasing means comprises a flat spring 48 attached to a paddle 44.

As the inflatable body inflates, the disc rotates in an anti-clockwise direction. Movement of the upper limit peg 46 caused by the anti-clockwise rotation of the disc puts tension on the flat spring 48 which at a certain position will flip to the position shown by the dotted lines. At this point the paddle will be pushed into the position shown by the dotted lines of the paddle, and the device will then deflate. Deflation of the device results in the disc rotating in a clockwise manner until the lower limit peg 45 engages with the flat spring 48 and flips it back to its original (closed) position.

Referring to FIG. 4*b*, a further embodiment of the controller of FIG. 4*a* is shown. Corresponding parts have been given corresponding reference numerals. The controller is designated generally by the reference numeral 50, and operates in a similar manner to that described with reference to FIG. 4*a*. However, the moveable portion 42 in the form of a disc is connected to an inflatable body by means of elongate member 51. The elongate member 51 is inelastic and is attached to an upper surface of the inflatable body. The controller 50 further comprises a lower arm 52 which is attached to a lower surface of the inflatable body. As the inflatable body inflates, the elongate member 51 is caused to move in the direction of arrow A. This results in rotation of the disc 42, and further operation of the controller 50 is similar to that described with reference to FIG. 4*a*.

When the inflatable body deflates, the elongate member 51 moves in direction of arrow B, returning the moveable portion 42 to its first position.

Referring to FIGS. 6 and 7 various configurations for the inflatable body forming part of the CPM device as claimed in the second aspect of the invention are shown, although any other suitable shape or configuration of one or more inflatable bodies could be used.

In FIG. 6 the inflatable body comprises a single inflatable bag or bladder 60. A first end 61 of the elongate member 21 is attached to an inner surface 62 of the bag. As the bag inflates, the end 61 is pulled up with the rising height of the surface.

Referring to FIG. 7, the inflatable body also comprises a single inflatable bag or bladder 70. The elongate member 21 divides into two end portions 71, 72 each having an end 73, 74 attached to an inner surface of the inflatable bag. As the bag inflates, the elongate member 21 will be drawn into the inflatable container 70.

Referring to FIG. 8 the inflatable body 80 comprises a plurality of interconnected bladders or bags.

Referring to FIG. 9 a further embodiment of a CPM device according to the second aspect of the present invention is designated generally by the reference numeral 90. The CPM device comprises a controller 91 and an inflatable body 92. The controller 91 is connected to the inflatable body by means of a tube 93 which may be made of any suitable material such as a plastics material.

Referring to FIG. 10, a CPM device according to a second aspect of the present invention is designated generally by the reference numeral at 100. The CPM device comprises a controller 101 of the type illustrated in FIG. 4*b* and described hereinabove. The controller 101 comprises first elongate member 102 and a second elongate member 103. The CPM device further comprises an inflatable body 104. Inflation of the inflatable body 104 results in elongate member 102 moving in the direction of arrow A. Further operation of the CPM device 100 is described hereinabove with reference to FIGS. 4*a*, 4*b* and 5.

The invention as herein before described with reference to the accompanying drawings relates to a controller and a CPM device incorporating the controller. The controller depends on positional feedback via a mechanical linkage. Positional feedback is particularly relevant to flexion of the hip and knee joints. In such a situation, the inflatable body of the invention according to the second aspect of the invention will be placed under a thigh of a patient, and the pressure in the inflatable body exerted by the thigh increases during low flexion angles, but then decreases at high flexion angles. In such a situation, it would not be possible to use a controller which sensed increasing pressure as this would not be a suitable control parameter for setting the upper range of movement limit. An alternative however would be to sense displacement or volume within the bag.

The two embodiments described herein above each make use of mechanical hysteresis, in that the second biasing means will flip between one position and another position once the moveable portion has moved to a certain position. However, mechanical hysteresis is not a necessary feature of the present invention.

I claim:

1. A continuous passive motion device comprising:

a controller comprising:

a housing;

a moveable portion moveable within the housing between an first position and a second position; and positioning means for causing the moveable portion to return to the first position after movement to or towards the second position; and an inflatable body attached to the controller, and pump means attached to the controller for pumping air into the device, wherein in use when the controller is in the second position, the inflatable body may be inflated by air supplied by the pump means, and when the controller is in the first position, the inflatable body deflates, wherein the inflation/deflation cycle is effected entirely by power derived from the air supply and wherein the inflatable body is attached to the controller by an elongate member having a first end and a second end, the first end of the elongate member being attached to the inflatable body, and the second end of the elongate member being attached to the moveable portion of the controller.

2. A device according to claim 1 wherein the positioning means comprises first biasing means for biasing the moving portion in the first position.

3. A device according to claim 2 further comprising at least one aperture which aperture is closed when the moveable portion is in its second position.

4. A device according to claim 3 wherein the elongate member comprises a length of elastic.

5. A device according to claim 2 wherein the controller further comprises second biasing means responsive to the relative position of the moveable portion within the housing, to cause the moveable portion to move from a predetermined position to either the first position or second position.

6. A device according to claim 5 wherein the second biasing means comprises a disk spring attached to the moveable portion and engageable with the housing.

7. A device according to claim 2 wherein the first biasing means comprises a retractor spring attached to the moveable portion and to the housing to bias the moveable portion to the first Position.

8. A device according to claim 2 wherein the first biasing means comprises a compression spring attached to the moveable portion and to the housing to bias the moveable portion to the first position.

9. A device according to claim 1 wherein the controller comprises an elongate body defining the housing within which is positioned the moveable portion.

10. A device according to claim 1 wherein the housing comprises an outer housing portion and an inner housing portion and at least one vent is formed in the inner housing portion.

11. A device according to claim 10 further comprising a moveable sleeve positioned within the inner housing and which is moved by the moveable portion to close the at least one vent when the moveable portion is in the first position.

12. A device according to claim 11 wherein the moveable portion is positioned within the sleeve which in turn is positioned within the inner housing portion.

13. A device according to claim 1 wherein the housing is shaped to have first detent means defining a lower displacement limit of the moveable portion within the housing, and second detent means defining another displacement limit of the moveable portion within the housing.

14. A device according to claim 13 wherein the positions of the first and second detent means are adjustable.

15. A device according to claim 1 wherein the moveable portion is substantially disk shaped and is positionable within a housing having a curved portion to accommodate the disk.

16. A device according to claim 15 wherein the controller further comprises a paddle pivotally moveable between a first paddle position and a second paddle position.

17. A device according to claim 15 wherein the first biasing means comprises the coil or retractor spring and the second biasing means comprises a flat spring attached to the paddle.

* * * * *